United States Patent [19]

Ichikawa

[11] Patent Number: 4,702,239

[45] Date of Patent: Oct. 27, 1987

[54] UNDERWEAR FOR MEN

[76] Inventor: Tadashi Ichikawa, 22, Kasuga-cho, Gifu-shi, Gifu-ken, Japan

[21] Appl. No.: 846,709

[22] Filed: Apr. 1, 1986

[30] Foreign Application Priority Data

Apr. 3, 1985 [JP] Japan ..... 60-71400

[51] Int. Cl.[4] ..... A61F 5/40

[52] U.S. Cl. ..... 128/159; 2/403

[58] Field of Search ..... 2/403, 405; 128/159, 128/158

[56] References Cited

U.S. PATENT DOCUMENTS

| | | | |
|---|---|---|---|
| 2,018,782 | 10/1935 | Gephart | 2/403 |
| 2,408,723 | 10/1946 | Arpin et al. | 2/403 |
| 2,419,867 | 4/1947 | Woodman | 2/403 |
| 2,684,673 | 7/1954 | Lerman | 2/403 X |
| 3,621,846 | 11/1971 | Lehman | 128/159 |
| 3,774,241 | 11/1973 | Zerkle . | |
| 4,195,630 | 4/1980 | Connery et al. | 128/159 |

FOREIGN PATENT DOCUMENTS 2204373 5/1974 France .

15730 3/1916 United Kingdom .

*Primary Examiner*—H. Hampton Hunter

*Attorney, Agent, or Firm*—Stephen G. Rudisill

[57] ABSTRACT

An underwear for men comprises a continuous cloth belt and an adjustable elastic belt for fastening the cloth belt onto the waist of a user. The cloth belt is integrally provided with a hip covering portion which covers the user's hips and to which the elastic belt is fixed; a crotch covering portion having a narrow breadth than the hip covering portion; a belly covering portion having a wider width than the crotch covering portion; and a pending portion adapted to be turned over the elastic belt in such a way that it hangs down therefrom in front of the belly covering portion. The crotch covering portion includes a hole through which the penis of the user is exposed to the outside and an accommodating portion in the form of a cover piece for supporting the scrotum of the user. The pending portion is provided with a corresponding accommodating portion for supporting the user's penis as it is exposed from the hole in the crotch covering portion.

4 Claims, 8 Drawing Figures

UNDERWEAR FOR MEN

FIELD OF THE INVENTION

The present invention relates to a form of underwear for men which covers the wearer's belly, crotch and hips with a continuous sheet of cloth in the form of a belt.

DESCRIPTION OF THE PRIOR ART

One form of such an underwear has been previously known as an underwear belt (loincloth). As shown in FIG. 8, this underwear belt is a sheet of cloth 31 in the form of a belt of constant width and having a string 32 connected to the end base thereof. When a wearer puts on this form of underwear, he first ties the string 32 around his waist while positioning the end base 33 of the sheet of cloth 31 on the side of his hip and then passes the top end portion of the sheet of cloth 31 under his crotch and pulls it up to the front of his belly, finally passing it between the string 32 and his belly so that the top end portion 34 hangs down after being turned over at the string 32.

In Japan, such underwear belts have been traditionally used as one of the types of underwear for men since early times. Their constitution is simple, as described above, and is easy to put on and take off, and provides sufficient ventilation to ensure that the area of the wearer's crotch does not become steamy. The body of the wearer is also kept cool. They are thus good for health, and underwear belts of this kind are conveniently used these days by hospital patients, physically handicapped persons and the like, as well as those who have become favorably accustomed to using them.

However, such conventional underwear belts are disadvantageous in the manner wherein they are applied to the crotch, since the sheet of cloth 31 does not conform closely to the private parts because of its wide breadth and the middle portion of the sheet of cloth 31 thus becomes bulky and loose under the crotch. Moreover, the private parts are not held securely and, thus there is a feeling of instability.

SUMMARY OF THE INVENTION

The main object of the present invention is to provide an underwear for men designed to fit a user's crotch and ensure that the user can comfortably wear it.

Another object of the present invention is to provide an underwear by which the private parts of the user can be held securely.

Still another object of the present invention is to provide an underwear ensuring that the user's penis and scrota do not contact each other so as to prevent steaminess in the pubic region.

A further object of the present invention is to provide an underwear ensuring that the private parts of the user are not pressed by the tension of a sheet of cloth caused by the movement of the user.

To these ends, the present invention provides in one of its aspects an underwear for men comprising a sheet of cloth and a fastening part for fastening the sheet of cloth on the waist of the user, the sheet of cloth integrally having a hip covering portion which covers the user's hips and to which the fastening part is fixed, a crotch covering portion having a narrower breadth than the hip covering portion in order to cover the user's crotch, a belly covering portion having a wider breadth than the crotch covering portion in order to cover the user's belly, and a pending portion with a tapered top area which is turned over the fastening part and depends therefrom in front of the belly covering portion.

The present invention provides in another of its aspects an underwear for men further comprising a hole formed in the crotch covering portion for exposing the user's penis to the outside thereof, and an accommodating part provided on the pending portion for accommodating the penis exposed from the hole.

Other and further objects of this invention will become obvious upon an understanding of the illustrative embodiments about to be described or will be indicated in the appended claims, and various advantages not referred to herein will occur to one skilled in the art upon employment of the invention in practice.

FIRST EMBODIMENT

Figure 1:
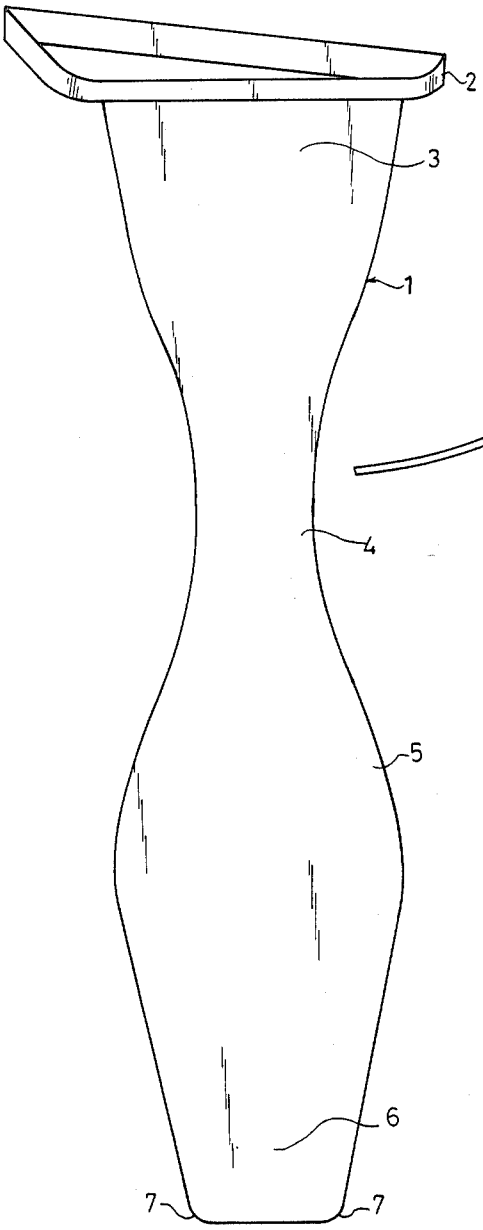
FIG. 1 is a front view of an underwear for men which is the first embodiment of the present invention.
Figure 8:
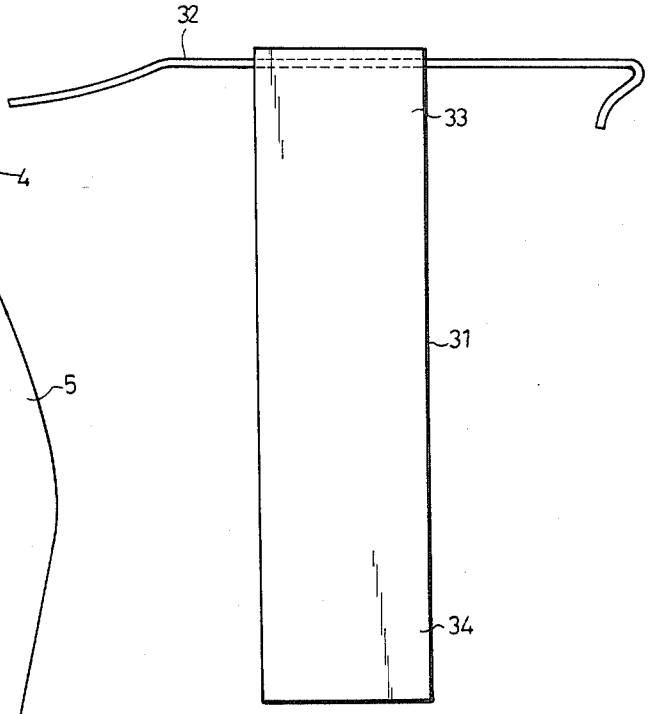
FIG. 8 PRIOR ART
FIG. 8 is a front view of a conventional underwear belt.

Referring to FIG. 1, an underwear which is the first embodiment of the present invention is constituted by a cotton cloth belt 1 and an annular rubber string 2 provided as a fastening part. The cloth belt 1 is integrally formed from a sheet of cloth so as to have a hip covering portion 3 for covering the user's hips during the put-on time, a crotch covering portion 4 for covering the user's crotch, a belly covering portion 5 for covering the user's belly, and a pending portion 6 which is turned over the annular string 2 and hangs down therefrom in front of the belly covering portion 5. The annular string 2 is sewn to the base edge of the hip covering portion 3. The crotch covering portion has side edges in the form of bows and is gradually tapered in the directions to the middle portion thereof. The pending portion 6 has biased side edges and is tapered to the top. Arcuate edges 7 are formed at both edges of the top portion thereof.

The usage of this underwear will be described hereunder. The user first fits the annular string 2 around his waist by utilizing elasticity of the string while positioning the hip covering portion 3 at his back and passes the cloth belt 1 through the crotch from his back to the front. Then he passes the top pending portion 6 between the string 2 and the belly and turns it over the string 2, finally hanging it down therefrom. Thus, the hips, the crotch, the belly and the private parts of the user are covered by the cloth belt 1. In this put-on state, the user is comfortable with the crotch covering portion 4 fitting the configuration of the user's crotch. Since the pending portion is tapered, it does not fold or crease in the trousers, so that the user may not be discomforted. When the user's skin is touched by the edge of the pending portion 6, it does not ache because the pending portion 6 has the arcuate edges 7. Moreover, the cloth belt 1 is not shifted nor slipped down by the ordinary action of the user, because it is securely fastened around the waist by virtue of elastic force of the annular string 2.

SECOND EMBODIMENT

Figure 2:
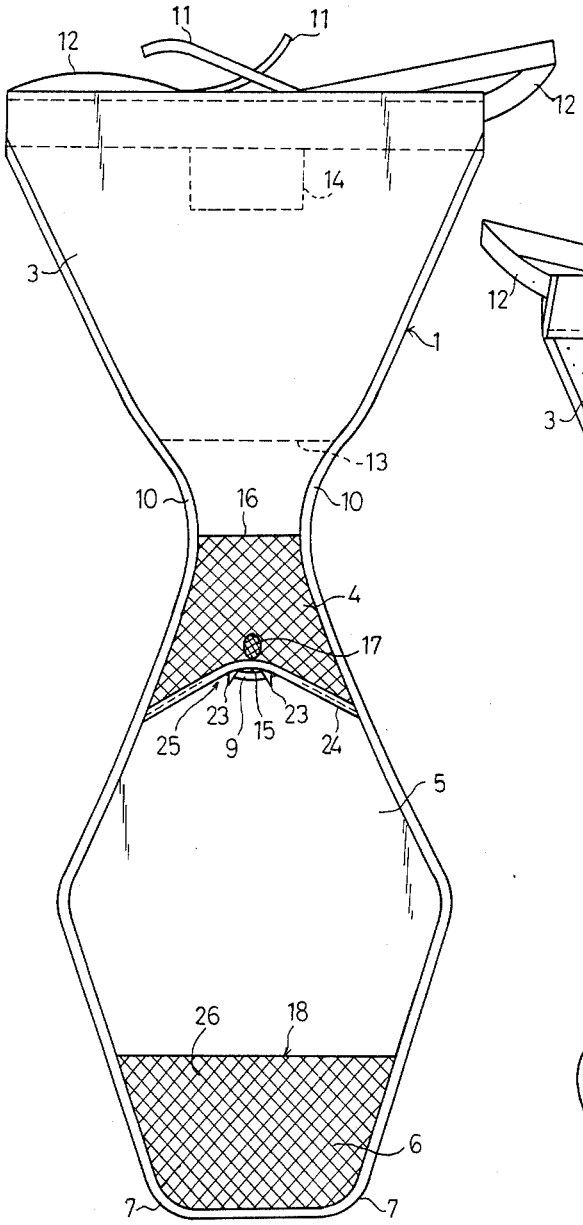
FIG. 2 is a front view showing the appearance of an underwear for men which is the second embodiment of the present invention.
Figure 3:
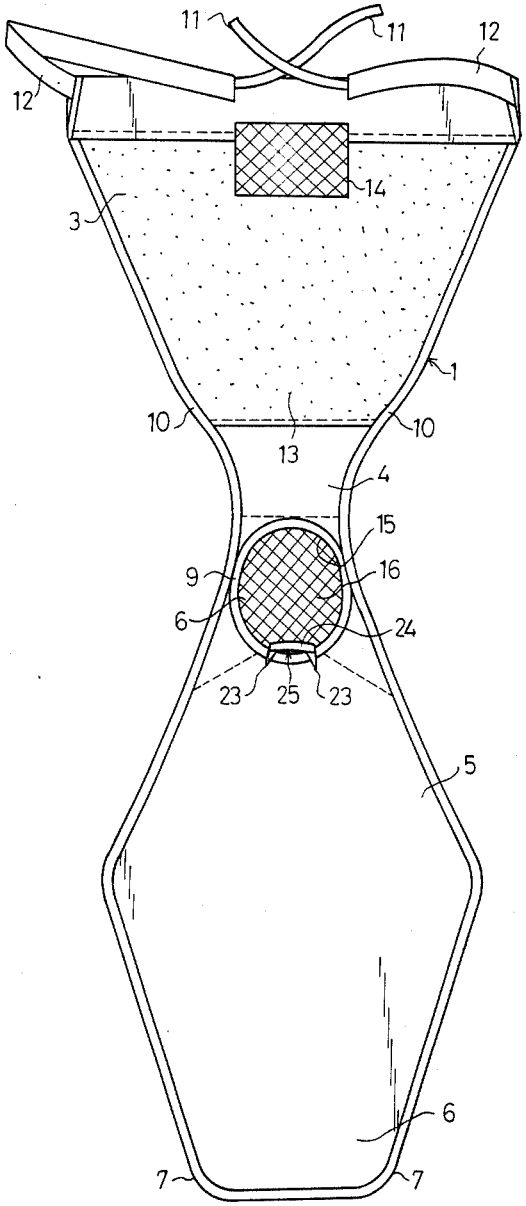
FIG. 3 is a rear elevation illustrating the rear view of the underwear in relation to FIG. 2.

FIG. 2 shows the appearance of an underwear which is the second embodiment of the present invention, and FIG. 3 shows the reverse side of the same. A pair of left and right rubber belt strings 12 is attached to the base edge formed at one end of the cloth belt 1 having a hem 10. A cotton tie string 11 is sewn to each top end of the belt strings 12. An inner sheet of cloth 13 made of knitted material for goods contacting the hips of the user is overlaid and sewn to the reverse side of the hip covering portion 3 over the whole area thereof, and a pocket 14 made of lace is sewn to the reverse side of the middle portion of the hip covering portion 3, the pocket 14 being opened at its upper edge. At the middle of the crotch covering portion 4 is formed an hole 15 which has a hem 9 formed therearound and has a pair of left and right notches 23 formed at the lower edge portion of the hole 15. The hole 15 is covered from the exterior side thereof by a cover piece 16 made of lace capable of some expandability so that the hole 15 itself is expandable. The lower edge of the cover piece 16 having a hem 24 is not sewn to the cloth belt 1, and an opening 25 is formed therebetween. A pouch piece 26 made of lace for forming an accommodating portion 18 is sewn to an area of the pending portion 6, the upper edge of the accommodating portion being opened.

When the user puts on the underwear which is shown in the second embodiment, he first fits both belt strings 12 around his waist while positioning the hip covering portion 3 at his back and passes both tie strings 11 around his waist and ties them in front of his belly. As, in this state, the inner sheet of cloth 13 made of knitted material touches the skin of the user, he feels warm and comfortable.

Figure 4:
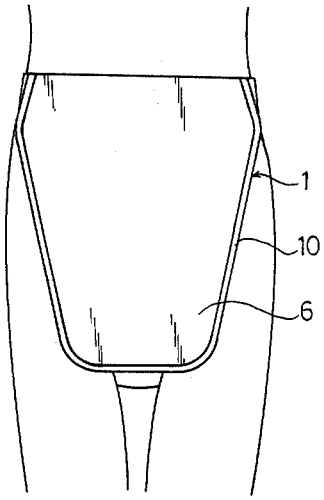
FIG. 4 is a front view illustrating the put-on state of the underwear shown in FIG. 2.
Figure 5:
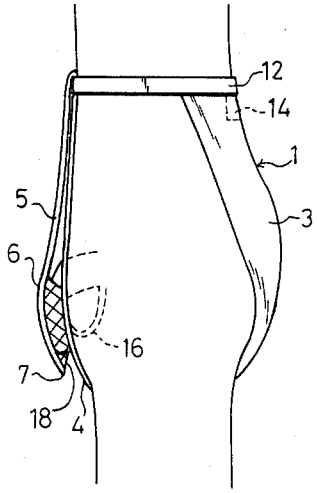
FIG. 5 is a side elevation illustrating the put-on state of the underwear in relation to FIG. 4.

Then, the user applies the crotch covering portion 4 to his crotch and passes the scrota through the hole 15 so as to accommodate it in the cover piece 16 while passing the penis through the hole 15 and the opening 25, the penis thereby being exposed outwardly. In this state, there is no risk of tightly fastening the root of the penis, since the notches 23 are formed in the hole 15 at the position corresponding to the opening 25. Next, as shown in FIG. 4, the user passes the pending portion 6 of the cloth belt 1 between the tie strings 11 and the belly and turns it thereover, finally accommodating, as shown in FIG. 5, the penis in the accommodating portion 18 formed on the pending portion 6. Thus the unstableness of the penis caused by the action of the user can be reduced. The magnet 17 contacts the inside root portion of the penis.

In this put-on state, the scrota in the cover piece 16 and the penis in the accommodating portion 18 are separated from each other, thus evading close contact therebetween. The ventilation of the pubic area is thereby improved enough to prevent steaminess thereof. Since the cover piece 16 is sewn the cloth belt 1 and is capable of being expanded, there is no risk of pressing the scrota when the crotch covering portion 4 is tensioned by the standing and sitting action of the user. Since the length of the pending portion 6 of the cloth belt 1 is designed to be short in accordance with the position of the penis, this portion is not bulky under the crotch and it is easy for the penis to be taken out and accommodated, thus preventing inconvenience during the time of urination.

Figure 6:
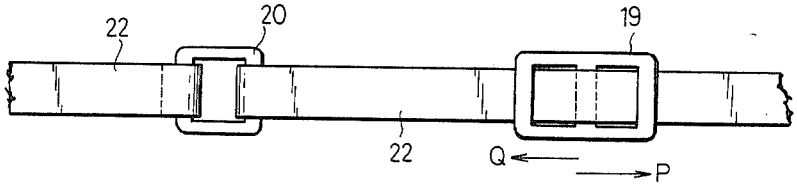
FIG. 6 is a partial front view showing the alteration of a fastening part.
Figure 7:
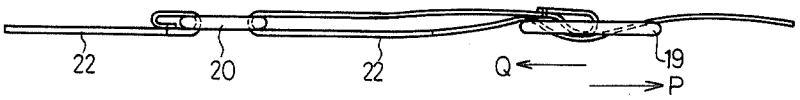
FIG. 7 is a plan view in relation to FIG. 6.

FIGS. 6 and 7 show an example of an altered fastening part. In these drawings, a rubber belt string 22 has a connection ring 20 and a sliding buckle 19, and the length of the belt string 22 is lengthened or shortened in accordance with the movement of the sliding buckle 19 in the directions indicated by the arrows P and Q. Thus the fastening force of the belt string against the waist can be conveniently adjusted as desired while the user is putting on this underwear.

As many widely different embodiments of this invention may be made without departing from the spirit and scope thereof, it is to be understood that the invention is not limited to the specific embodiments thereof except as defined in the appended claims.

I claim:

1. An underwear for men comprising a cloth belt and an adjustable elastic belt for fastening said cloth belt on the waist of the user, said cloth belt integrally having:

a hip covering portion which covers the user's hips and to which said elastic adjustable belt is fixed;

a crotch covering portion having a narrower breadth than said hip covering portion in order to cover the user's crotch;

a belly covering portion having a wider breadth than said crotch covering portion inorder to cover the user's belly; and a pending portion which is adapted to be turned over said elastic adjustable belt in such a way that it hangs down therefrom in front of the belly covering portion, said elastic belt preventing said cloth belt from being longitudinally displaced due to movement of the user, said crotch covering portion including an accommodating portion in the form of a cover piece for accommodating and supporting the scrotum of the user, and having a hole through which the penis of the user is exposed to the outside, and said pending portion having an accommodating portion for accommodating the penis exposed from said hole, the length of said pending portion being such that the penis accommodating portion lies adjacent the penis of the user exposed from said hole.

2. An under wear for men according to claim 1, wherein said hip covering portion has a pocket formed at the position corresponding to the rear waist of the user.

3. An under wear for men according to claim 1, wherein said pending portion is tapered at one end so that the side remote from the elastic belt over which the pending portion is turned is smaller in dimension than the side proximate to said elastic belt.

4. An under wear for men comprising a cloth belt and an elastic adjustable belt for fastening said cloth belt on the waist of the user, said cloth belt integrally having:

a hip covering portion which covers the user's hips and to which said elastic adjustable belt is fixed;

a crotch covering portion having a narrower breadth than said hip covering portion in order to cover the user's crotch, said crotch covering portion having a hole thorugh which the penis of the user is exposed to the outside and which is covered from the exterior side thereof by a cover means in such a way that said hole is expandable in the longitudinal direction of said cloth belt thereby to prevent the penis from being oppressed against the periphery of said hole, said cover in combination with an adjacent portion of the crotch covering portion acting as a means for supporting the scrotum of the user;

a belly covering portion having a wider breadth than said crotch covering portion in order to cover the user's belly; and a pending portion which is turned over said elastic adjustable belt and hangs down therefrom in front of the belly covering portion, said pending portion having an accommodating portion for accommodating the penis exposed from said hole, the length of said pending portion being such that the penis accommodating portion lies adjacent the penis of the suer exposed from said hole, and said pending portion being tapered at one end so that the side remote from the elastic belt over which the pending portion is turned is smaller in dimension than the side proximate to said elastic belt.

* * * * *